US005449390A

United States Patent [19]

Duncan et al.

[11] Patent Number: 5,449,390

[45] Date of Patent: Sep. 12, 1995

[54] FLUE GAS CONDITIONING SYSTEM USING VAPORIZED SULFURIC ACID

[75] Inventors: Kent S. Duncan, Martinsville; Robert A. Wright, Indianapolis, both of Ind.

[73] Assignee: Wilhelm Environmental Technologies, Inc., Indianapolis, Ind.

[21] Appl. No.: 207,215

[22] Filed: Mar. 8, 1994

[51] Int. Cl.[6] ..... B03C 3/013

[52] U.S. Cl. ..... 55/222; 55/228; 95/72; 96/52; 96/53; 96/74; 110/345; 261/116; 261/DIG. 75; 422/173

[58] Field of Search ..... 96/52, 53, 74; 95/71, 95/72, 73, 58, 60, 214, 227, 228, 288, 66; 55/222, 228, 267, 268; 261/116, 76, 142, DIG. 75; 110/345; 422/176, 174; 423/243.01

[56] References Cited

U.S. PATENT DOCUMENTS

| | | | |
|---|---|---|---|
| 2,602,734 | 7/1952 | Hedberg et al. | 423/99 |
| 3,494,099 | 2/1970 | Eng et al. | 96/53 X |
| 3,665,676 | 5/1972 | McKewen | 96/52 X |
| 3,704,569 | 12/1972 | Hardison et al. | 95/60 |
| 3,722,178 | 3/1973 | Aaland et al. | 95/4 |
| 3,800,505 | 4/1974 | Tarves, Jr. | 261/116 X |
| 4,070,424 | 1/1978 | Olson et al. | 261/142 |
| 4,208,192 | 6/1980 | Quigley et al. | 423/215.5 |
| 4,229,411 | 10/1980 | Kisters et al. | 96/53 X |
| 4,305,909 | 12/1981 | Willett et al. | 422/173 X |
| 4,333,746 | 6/1982 | Southam | 422/168 X |
| 4,548,789 | 10/1985 | Ballestra | 422/160 |
| 4,909,161 | 3/1990 | Germain | 96/53 X |
| 4,957,512 | 9/1990 | Denisov et al. | 95/66 |
| 4,975,264 | 12/1990 | Franken | 423/522 |
| 5,011,516 | 4/1991 | Altman et al. | 55/5 |
| 5,030,428 | 7/1991 | Dorr et al. | 423/215.5 |
| 5,061,467 | 10/1991 | Johnson et al. | 423/522 X |
| 5,074,226 | 12/1991 | Lynch | 110/345 |
| 5,370,720 | 12/1994 | Duncan | 55/222 |

*Primary Examiner*—Richard L. Chiesa
*Attorney, Agent, or Firm*—Ice Miller Donadio & Ryan

[57] ABSTRACT

A flue gas conditioning system uses the waste heat of the flue gas to heat a sulfuric acid solution to add sufficient heat energy to the solution to vaporize the solution before being injected into the flue gas to condition the flue gas so that particulate removal by a precipitator is enhanced.

12 Claims, 3 Drawing Sheets

FLUE GAS CONDITIONING SYSTEM USING VAPORIZED SULFURIC ACID

FIELD OF THE INVENTION

This invention relates to a system for treating boiler flue gas to improve the removal of particulate matter contained therein by electrostatic and other means, and more particularly, to a flue gas conditioning system that utilizes vaporized sulfuric acid as the conditioning agent for the particulate matter prior to passage through an electrostatic precipitator or filter.

BACKGROUND OF THE INVENTION

The increasing demand for electrical power has forced electrical utilities to bum increasing quantities of fossil fuels such as coal and oil. However, electric utilities also face increasing environmental standards imposed upon their operations by state and federal regulatory agencies that mandate reduced particulate and acid generating smoke stack emissions. To reduce acid generating emissions, electrical utilities have turned to burning low-sulfur coal in their boilers to generate the steam necessary for electric power generation. To reduce the particulate emissions, electric utilities generally use a flue gas treatment system to remove a majority of the particulate matter in the gas effluent passing out of the smoke stack. Such flue gas treatment systems typically comprise an electrostatic device such as an electrostatic precipitator or a fabric filter baghouse to remove the particulate. Such devices may also provide a source of conditioning agent to the flue gas to enhance the effectiveness of the precipitator or filter in removing the particulate.

The efficiency of an electrostatic precipitator in removing particulate matter from the boiler flue gas is partially dependent upon the electrical resistivity of the entrained particulate matter in the boiler flue gas. The entrained particulate matter expelled from a boiler fired with low-sulfur coal, i.e., coal having less than 1 percent sulfur, has been found to have a resistivity of approximately $10^{13}$ ohms/cm. It has been determined that the most efficient removal of particulate matter by electrostatic precipitation occurs when the particulate matter resistivity is approximately $10^{10}$ ohms/cm. Therefore, to obtain more effective use of an electrostatic precipitator, the resistivity of the entrained particulate matter from low-sulfur content coal must be reduced. Electrical utilities have long used conditioning agents introduced into the flue gas flow upstream of the electrostatic precipitator to reduce the resistivity of the entrained particles. Various chemicals, such as water, anhydrous ammonia, sulfuric acid, sulfur trioxide, phosphoric acid and various ammonia-bearing solutions have been used as conditioning agents.

Prior art systems used to introduce sulfuric acid into the flue gas have not been economically or technically successful. Substantial quantities of energy have to be transferred to the, sulfuric acid to cause it to vaporize quickly as it is introduced into the flue gas so that it will effectively condition the flue gas for particulate removal. Sulfuric Acid is an aqueous solution. Consequently, sufficient heat energy to vaporize the water of the solution must be applied to effect vaporization thereby increasing the cost of operation. Further, the acid must be brought to disassociation temperature (600°–650° F.) very quickly to prevent metal corrosion.

Thus, it would be a substantial advance in the art to have a system for treating boiler flue gas to improve the removal of particulate matter that utilizes a vaporized solution of sulfuric acid as a conditioning agent that is both effective and economically acceptable. Accordingly, a system for treating boiler flue gas to improve the removal of particulate matter that utilizes vaporized sulfuric acid solution that taps available "waste" energy sources within the system to increase the energy level of the solution to facilitate vaporization in an effective and economically feasible manner would overcome the deficiencies in the prior art.

BRIEF SUMMARY OF THE INVENTION

A system for treating boiler flue gas to improve the removal of particulate matter in accordance with the present invention is used in a boiler system having a flue gas conduit for conveying heated flue gas from the fuel burning chamber of the boiler to a particulate removing device such as a precipitator. A source of technical grade liquid sulfuric acid solution is provided. An acid reactor means having a hollow interior is provided. Pipe means for conveying the liquid sulfuric acid from the source to the interior of the reactor means is provided. A metering means is positioned in the pipe means for controlling the amount of liquid sulfuric acid solution that is conveyed to the reactor means through the pipe means.

A heat exchanger means having an inlet and an outlet is positioned in the economizer outlet flue gas conduit. A first pump means is connected to the inlet of the heat exchanger means for introducing compressed process air into heat exchanger means, the heat exchanger means transferring heat from the flue gas to the process air.

A second pump means is connected to the interior of the reactor means for providing compressed air to be combined with the sulfuric acid solution to cause the sulfuric acid solution to be atomized into droplets within the reactor means. Means for conveying the heated compressed air from the heat exchanger means to the interior of the reactor means is provided so that the heated process air comes into contact with the atomized sulfuric acid solution, the process air having been heated sufficiently by said heat exchanger means to cause the sulfuric acid solution to be vaporized rapidly. Injection means is connected to the acid reactor means for injecting the vaporized sulfuric acid solution from the reactor means into the flue gas conduit before the particulate removing device.

The heat exchanger means may comprise a plurality of heat exchanger units positioned within the flue gas conduit and connected to one another in series so that the process air is heated progressively through the units.

An auxiliary heat means may be connected between the heat exchange means and first pump means for introducing additional heat to the process air if there is insufficient heat available in the flue gas to heat the process air sufficiently to cause the sulfuric acid solution to vaporize in the reactor means. The temperature of the flue gas may vary depending upon the power generation loads, and during off peak load conditions additional heat may be needed. The auxiliary heat means may be an electric heater or a heating unit that uses combustion of fossil fuels as the source of heat.

Accordingly, it is a primary object of the present invention to provide a system for treating boiler flue gas to improve the removal of particulate matter that utilizes vaporized sulfuric acid solution as the conditioning agent.

It is yet another object of the present invention to provide a system for treating boiler flue gas to improve the removal of particulate matter that utilizes vaporized sulfuric acid solution as the conditioning agent that makes use of waste heat of the system as an energy source to assist in the vaporization process.

These and other objects, advantages and features of the present invention shall hereinafter appear, and for the purposes of illustration but not for limitation, exemplary embodiments of the present invention shall hereinafter be described.

DETAILED DESCRIPTION OF THE PREFERRED EMBODIMENTS

Figure 1:
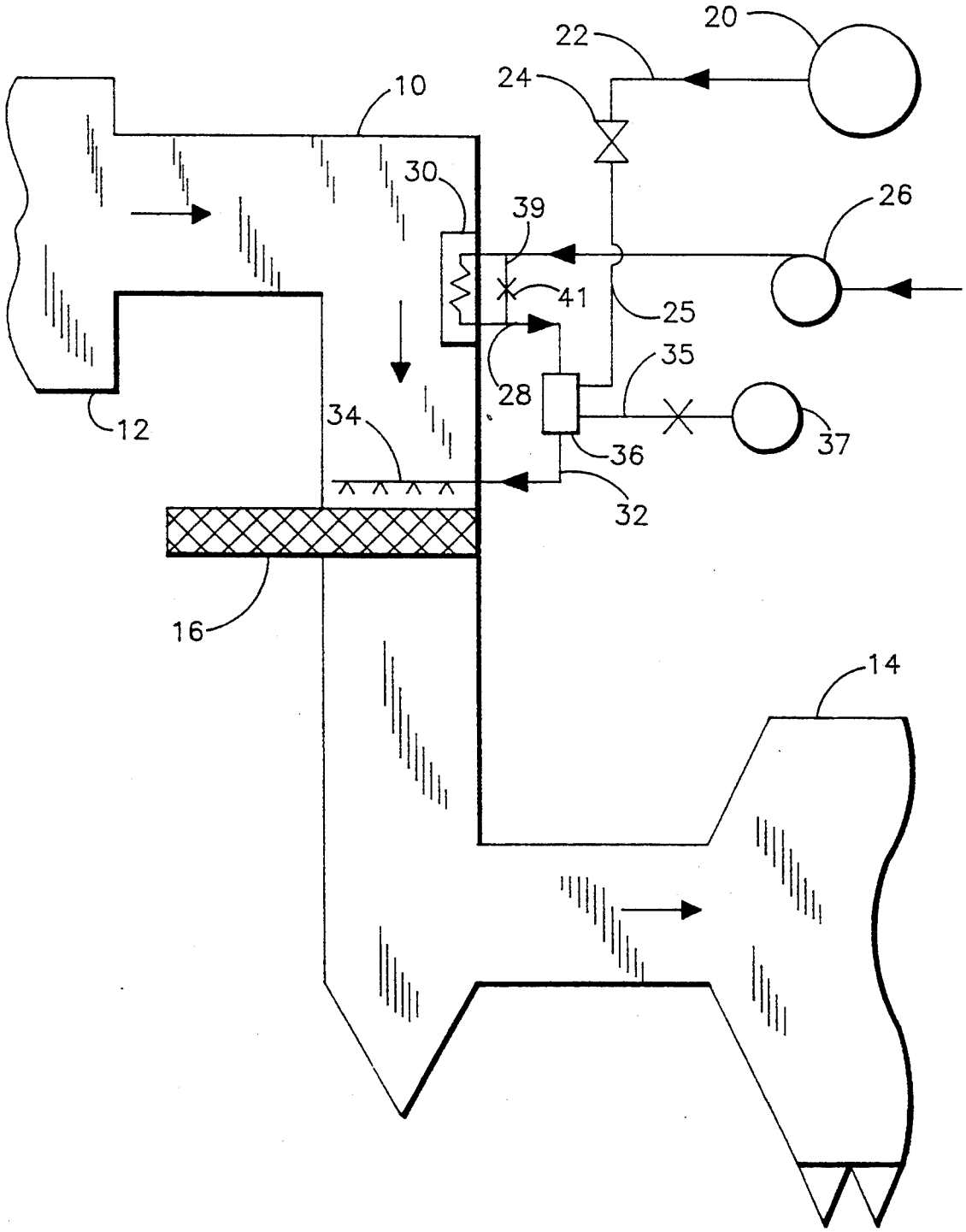
FIG. 1 is a block diagram of the various components of the present invention.

With reference to FIG. 1, a preferred embodiment of the present invention is illustrated. A conventional boiler system in which the present invention may be used comprises a flue gas conduit 10 connected between a fuel combustion chamber 12 of the boiler and a conventional electrostatic precipitator 14 used to remove particulate from the flue gas.

Flue gas exits the combustion chamber 12 at the economizer outlet at approximately 750 to 850 degrees fahrenheit. A conventional air preheater 16 is provided to transfer heat from the hot flue gas in conduit 10 to the air being introduced into the combustion chamber 12 in a conventional manner. A fan (not shown) conventionally forces air through the air preheater 16 and into the combustion chamber to provide oxygen for combustion and pressure to force the flue gas through the conduit 10.

The present invention comprises a supply of liquid sulfuric acid solution 20. The supply 20 may be a conventional carbon steel holding tank in which the sulfuric acid solution may be safely stored.

Source 20 is connected by appropriate hollow piping 22 to the inlet of metering valve 24. Metering valve 24 controls the flow of the acid solution from the source 20. The outlet metering valve 24 is connected by piping 25 which in turn is connected to the hollow interior of acid reactor 36 so that the sulfuric acid solution is passed to the interior of acid reactor 36.

The outlet of a first compressed air pump 26 is connected to the inlet of heat exchanger 30 that is positioned within conduit 10 in the stream of hot flue gas flowing from combustion chamber 12. First air pump 26 operates to pump compressed process air into heat exchanger 30. The process air flows through heat exchanger 30 wherein heat from the flue gas in conduit 10 is transferred to the process air to cause it to increase in temperature. The heated compressed process air is conveyed to the interior of acid reactor 36 by piping 28. A by-pass line 39 with a control valve 41 is provided for greater temperature control. If the temperature of the air leaving the heat exchanger 30 is too high, a selected quantity of unheated air can be allowed to pass through line 39 to lower the temperature of the air.

Figure 3:
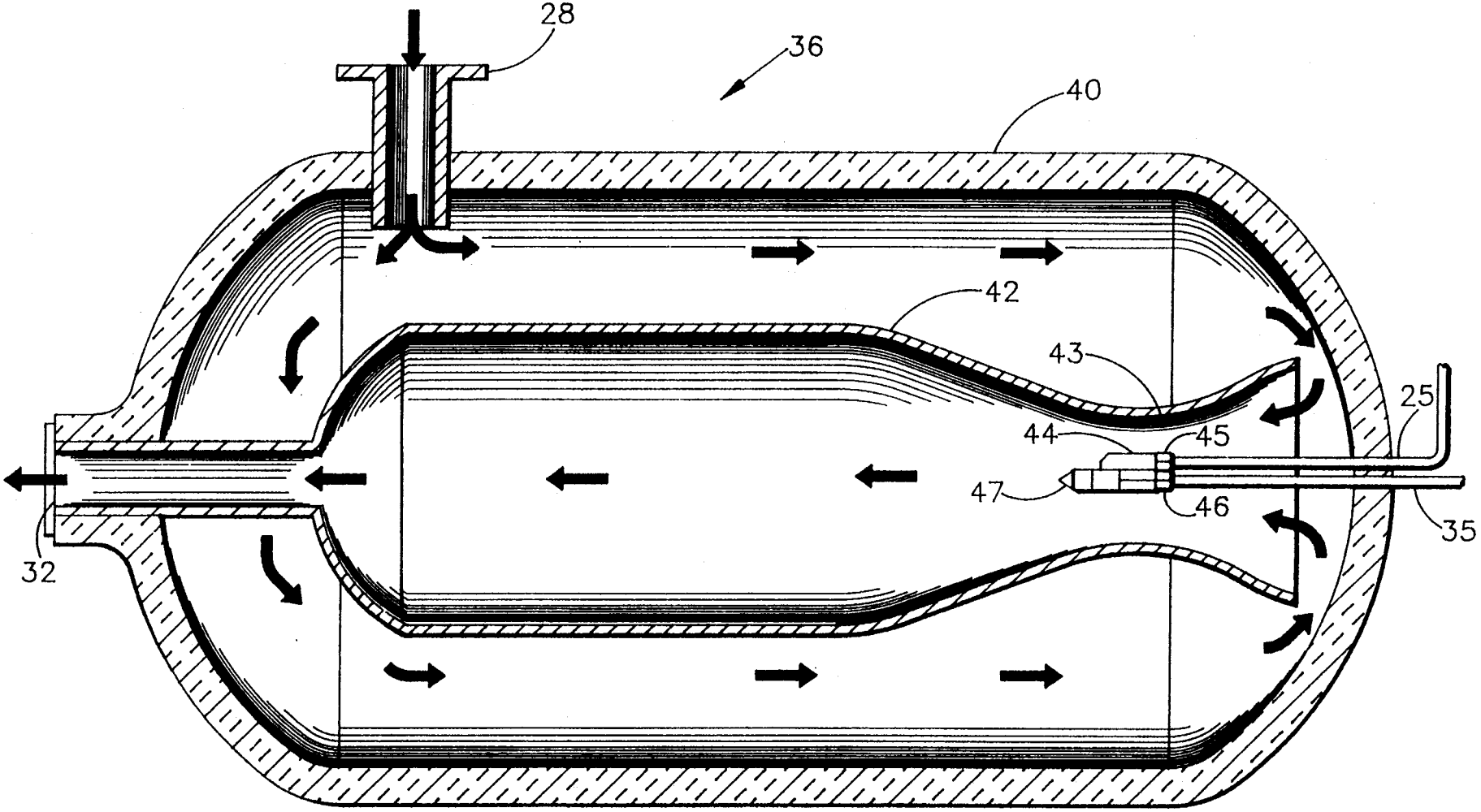
FIG. 3 is a cross sectional drawing of the reactor means of the preferred embodiment of the present invention.

Also connected to acid reactor 36 by hollow piping 35 is a second air compressor pump 37 which pumps atomizing air into the acid reactor 36. With reference to FIG. 3, the internal structure of acid reactor 36 is illustrated. Reactor 36 comprises an insulated housing 40 that encloses a reactor vessel 42. Piping 25 and 35 enter the side of housing 40 and are connected to an injector nozzle 44. Nozzle 44 is an atomizing spray nozzle sold under the trademark MICROFOG TM by EnviroCare International of Novato, Calif. Nozzle 44 has a first inlet connected to piping 25 and a second inlet 46 connected to piping 35 that communicates with a hollow interior of nozzle 44. A small outlet opening 47 also communicates with the hollow interior of nozzle 44. The compressed air from piping 35 and the sulfuric acid solution from piping 25 are combined in the interior of nozzle 44 and sprayed out of the outlet 47 in a very fine mist of droplets at the heated venturi throat and interior of vessel 42. Reactor 36 and vessel 42 are manufactured by EnviroCare International of Novato, Calif.

Piping 28 passes through the wall of housing 40. Heated air from piping 28 circulates around vessel 42 heating vessel 42 before the heated air enters restricted venturi throat 43 of vessel 42 and passes along nozzle 44. The heated air causes the atomized sulfuric acid to disassociate into $SO_3$ and $H_2O$ pass through vessel 42 into hollow piping 32 connected at the end of vessel 42. Sufficient heat is added to the process air by the heat exchanger 30 to raise the temperature of the process air to the point where it will very rapidly vaporize and disassociate the fine mist of sulfuric acid solution provided by injector nozzle 44. The venturi throat 43 aids in the vaporization and disassociation process by causing a reduction of the air pressure as the heated air passes through the restricted portion of the throat into the larger portion of vessel 42 as the fine mist of $H_2SO_4$ is sprayed into vessel 42 by nozzle 44.

The disassociated sulfuric acid solution then passes through hollow piping 32 to an injection assembly 34. Pipe 32 may be insulated to retain the transferred heat so that the vaporized solution will not condense before reaching injection assembly 34. The vaporized sulfuric acid solution is passed through injection assembly 34 which is positioned in the stream of flue gas in conduit 10 immediately before the air preheater 16. However, if pipe 32 is adequately insulated, injection assembly could be positioned after the air preheater 16 and before the precipitator 14 so that the sulfuric acid solution is injected into the flue gas just before entering the precipitator. The vaporized sulfuric acid solution acts to reduce the resistivity of the particulate in the flue gas thereby increasing the effectiveness of the precipitator 14 to remove the particulate from the flue gas.

It should be recognized that if one heat exchanger 30 is not sufficient to transfer enough heat to the process air to increase the temperature to the point where the acid solution mist in the reactor vessel 42 is quickly vaporized under normal operating conditions, additional heat exchanger units can be added in series to increase the heat transfer to the process air. The number of heat exchangers needed to produce sufficient heat transfer is dependent upon the size of the boiler system, the temperature and quantity of flue gas passing through conduit 10, and the quantity of process air needed to adequately vaporize the solution. Accordingly, the number of heat exchangers may be varied from a single unit to as many units as needed depending upon the parameters of the system.

Heat exchanger 30 may be any type of conventional air-to-air heat exchanger such as coupled pipe designs produced by Foster Wheeler Energy Corporation. Injector assembly 34 is also a conventional nozzle system produced by Wilhelm Environmental Technologies Inc. Air pump 26 is also a conventional pump such as those produced by Lamson Blower Co. or Hoffman Corporation.

Metering valve 24 can be controlled by conventional generating unit load following signal and by control circuitry that senses the resistivity of the particulate or precipitator response to changing flash resistivity and increases the flow of sulfuric acid solution if the resistivity increases.

Figure 2:
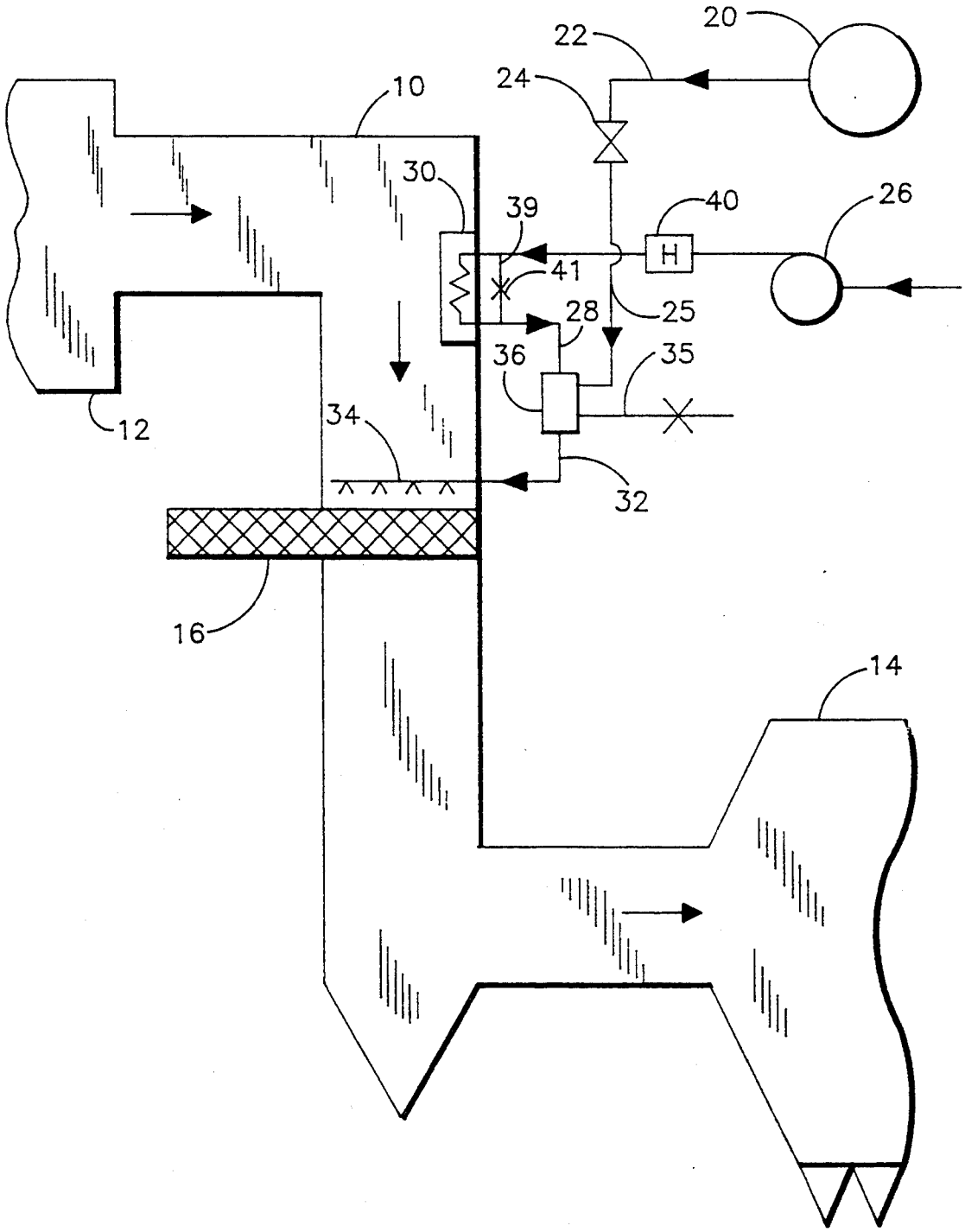
FIG. 2 is a block diagram of an alternative embodiment of the present invention.

With reference to FIG. 2, an alternative embodiment of the present invention is illustrated. The alternative embodiment illustrated is the substantially the same as the first embodiment with the same reference numbers used for the same corresponding part except that an auxiliary heating unit 40 is positioned between the output of pump 26 and heat exchanger 30. Typically, such an auxiliary heat unit is an electric heater or a heating unit that uses fossil fuel combustion as the source of heat. Alteratively, auxiliary heating unit could be installed after the heat exchanger to achieve the same effect.

Auxiliary heating unit 40 is used to provide additional heat to the process air where insufficient heat is provided by the flue gas to the heat exchanger 30 to allow for vaporization of the sulfuric acid solution in the reactor 36. If the boiler system is operating at a low level because of low electric generating loads, there may be insufficient heat provided by the flue gas to completely vaporize the sulfuric acid solution. Auxiliary heating unit 40 provides enough additional heat to allow the heat exchanger 30 to completely vaporize the solution during off peak load conditions. Since some heat is still being transferred by heat exchanger 30, the amount of additional heat required by auxiliary heating unit 40 to vaporize the sulfuric acid solution is minimized thereby reducing the overall cost of operation. Thus, even if sufficient heat is not available from the flue gas, the additional cost to produce vaporized sulfuric acid solution is substantially reduced making the system more economically feasible.

The present invention allows for the injection of vaporized sulfuric acid solution into the flue gas using the "waste" heat of the system that would otherwise go unused out the stack. The vaporized sulfuric acid solution can be used to adjust the resistivity of the flue gas to increase the efficiency of an electrostatic precipitator.

These and other benefits and advantages may be achieved by the present invention as described herein and defined in the appended claims. Further, it should be apparent that various equivalent alterations, changes and modifications to the present embodiments may be made without departing from the spirit and scope of the present invention as claimed in the appended claims.

We claim:

1. In a boiler system having a flue gas conduit for conveying heated flue gas from a fuel combustion chamber of the boiler to a particulate removing device, an improved system for treating boiler flue gas to improve the removal of particulate matter from the flue gas comprising:

a. a source of liquid sulfuric acid solution;

b. reactor means having a hollow venturi throat and interior;

c. pipe means for conveying said liquid sulfuric acid from said source to said interior of said reactor means;

d. metering means positioned in said pipe means for controlling the amount of liquid sulfuric acid solution that is conveyed to said reactor means through said pipe means;

e. heat exchanger means positioned in the flue gas conduit, said heat exchanger means having an inlet and an outlet;

f. first air means connected to said inlet of said heat exchanger means for introducing compressed process air into said heat exchanger means, said heat exchanger means for transferring heat from the flue gas to the compressed process air;

g. second air means connected to said reactor means for providing compressed air to be combined with said sulfuric acid solution to cause said sulfuric acid solution to be atomized into droplets within said reactor means in proximity to said venturi throat;

h. means for conveying said heated process air from said heat exchanger means into said interior of said reactor means and into contact with said atomized sulfuric acid solution, said process air having been heated sufficiently by said heat exchanger means to cause said atomized sulfuric acid solution to be vaporized;

i. injection means connected to said interior of said reactor means for injecting said vaporized sulfuric acid solution from said reactor means into the flue gas conduit before the particulate removing device.

2. An improved system for treating boiler flue gas to improve the removal of particulate matter in a boiler system, as claimed in claim 1, wherein said heat exchanger means comprises a plurality of heat exchanger units positioned within the flue gas conduit and connected to one another in series.

3. An improved system for treating boiler flue gas to improve the removal of particulate matter in a boiler system, as claimed in claim 1, further comprising an auxiliary heat means for heating the compressed process air thereby introducing additional heat to facilitate vaporization of the sulfuric acid solution.

4. An improved system for treating boiler flue gas to improve the removal of particulate matter in a boiler system, as claimed in claim 3, wherein said auxiliary heat means is an electric heater.

5. An improved system for treating boiler flue gas to improve the removal of particulate matter in a boiler system, as claimed in claim 3, wherein said auxiliary heat means is a heating unit that uses combustion of fossil fuels as the source of heat.

6. An improved system for treating boiler flue gas to improve the removal of particulate matter in a boiler system, as claimed in claim 1, wherein an atomizing nozzle is positioned within said interior of said reactor means in proximity to said venturi throat, said nozzle being connected to said pipe means to receive said sulfuric acid solution, said compressed air from said second air means being conveyed to said nozzle and combined with the sulfuric acid solution within said nozzle so that the combination of compressed air and sulfuric acid solution is sprayed out a small outlet opening in said nozzle under pressure causing said sulfuric acid solution to be atomized into droplets.

7. An improved system for treating boiler flue gas to improve the removal of particulate matter in a boiler system, as claimed in claim 6, wherein said atomizing nozzle has first and second inlets and a small outlet opening communicating with a hollow interior of said nozzle, said first inlet being connected to said pipe means to receive said sulfuric acid solution, said compressed air from said second source of compressed air being conveyed to said second inlet and combined with the sulfuric acid solution within said interior of said nozzle so that the combination of compressed air and sulfuric acid solution is sprayed out said small outlet opening in said nozzle under pressure causing said sulfuric acid solution to be atomized into droplets.

8. A system for treating boiler flue gas to improve the removal of particulate matter from the flue gas comprising:

a. a fuel combustion chamber for burning fuel to heat the boiler;

b. a particulate removing device;

c. a flue gas conduit for conveying heated flue gas from the fuel combustion chamber of the boiler to the particulate removing device;

d. a source of liquid sulfuric acid solution;

e. reactor vessel having a hollow venturi throat and interior;

f. a hollow pipe connecting said source of liquid sulfuric acid with said interior of said reactor vessel;

g. a metering valve in said pipe, said metering valve being adjustable to control the amount of said liquid sulfuric acid solution passing to said reactor vessel;

h. heat exchanger means positioned in the flue gas conduit having an inlet and an outlet;

i. a first source of compressed air having an outlet through which compressed process air is passed, said outlet connected to the inlet of said heat exchanger means so that the compressed process air is passed into said heat exchanger means; said heat exchanger means for transferring heat from the flue gas to the compressed process air;

j. a second source of compressed air connected to said reactor vessel, said second source of compressed air operable to provide compressed air to be combined with said sulfuric acid solution to cause said sulfuric acid solution to be atomized into a mist within said reactor vessel in proximity to said venturi throat;

k. a hollow pipe connected to the outlet of said heat exchanger means and communicating with the interior of said reactor vessel so that the heated compressed process air from said heat exchanger is brought into contact with the atomized sulfuric acid solution so that the sulfuric acid solution is vaporized;

l. an injection means communicating with the interior of said reactor vessel for introducing the vaporized sulfuric acid solution from said vessel into the flue gas conduit before the particulate removing device so that the flue gas is conditioned before entering said particulate removing device.

9. A system for treating boiler flue gas as claimed in claim 8, further comprising an auxiliary heat means for introducing additional heat to the compressed process air.

10. A system for treating boiler flue gas as claimed in claim 9, wherein said auxiliary heat means is an electric heater.

11. A system for treating boiler flue gas as claimed in claim 9, wherein said auxiliary heat means is a heating unit that uses combustion of fossil fuels as the source of heat.

12. An improved system for treating boiler flue gas to improve the removal of particulate matter in a boiler system, as claimed in claim 8, wherein an atomizing nozzle is positioned within said reactor vessel in proximity to said venturi throat, said nozzle having a first and second inlets and a small outlet opening communicating with a hollow interior of said nozzle, said first inlet being connected to said pipe means to receive said sulfuric acid solution, said compressed air from said second source of compressed air being conveyed to said second inlet and combined with the sulfuric acid solution within said interior of said nozzle so that the combination of compressed air and sulfuric acid solution is sprayed out said small outlet opening in said nozzle under pressure causing said sulfuric acid solution to be atomized into droplets.

* * * * *